US005224231A

United States Patent [19]

Nacar

[11] Patent Number: 5,224,231

[45] Date of Patent: Jul. 6, 1993

[54] POWERBRUSH ATTACHMENT

[76] Inventor: Ernesto Nacar, 5 Hedley Court, Brampton, Ontario, Canada, L6S 2B6

[21] Appl. No.: 809,870

[22] Filed: Dec. 18, 1991

[30] Foreign Application Priority Data

Dec. 28, 1990 [CA] Canada ..... 2033371

[51] Int. Cl.[5] ..... A46B 13/02

[52] U.S. Cl. ..... 15/22.2; 15/22.1; 15/160; 15/183; 15/200; 15/DIG. 5; 30/277; 173/205; 299/37

[58] Field of Search ..... 15/22.1, 22.2, 22.4, 15/28, 167.1, DIG. 5, 37, 180, 183, 50.2, 52.2, 93.1, 160, 181, 197, 200; 51/170 TL; 30/277; 173/205; 299/37

[56] References Cited

U.S. PATENT DOCUMENTS

| | | | |
|---|---|---|---|
| 729,187 | 5/1903 | King . | |
| 933,718 | 9/1909 | Mahoney . | |
| 1,007,888 | 11/1911 | Parker | 15/22.1 |
| 1,215,439 | 2/1917 | Wagner | 15/22.2 |
| 1,482,027 | 1/1924 | Ochse | 15/167.1 |
| 1,958,658 | 5/1934 | Engberg et al. | 15/207.2 |
| 2,211,741 | 8/1940 | Elwell | 30/277 |
| 2,282,728 | 5/1942 | Kern | 29/73 |
| 2,567,768 | 9/1951 | Bamberger | 74/44 |
| 2,671,914 | 3/1954 | Rucker | 15/22 |
| 2,799,035 | 7/1957 | Pfluger | 15/22.1 |
| 2,875,458 | 3/1959 | Tsuda | 15/22.1 |
| 3,072,937 | 1/1963 | Dyer | 15/22.1 |
| 3,216,734 | 11/1965 | Thompson | 15/22.1 |
| 3,260,289 | 7/1966 | Whitten, Jr. | 143/68 |
| 3,585,719 | 10/1967 | Kivela | 30/166 |
| 3,876,015 | 4/1975 | Kivela | 173/170 |
| 3,978,852 | 9/1976 | Annoni | 15/22.1 |
| 4,949,463 | 8/1990 | Chen | 30/500 |

FOREIGN PATENT DOCUMENTS

| | | | |
|---|---|---|---|
| 789223 | 1/1958 | United Kingdom | 15/180 |

*Primary Examiner*—Edward L. Roberts
*Attorney, Agent, or Firm*—Baker & Daniels

[57] ABSTRACT

A brush attachment for a power tool, such as an electric drill, capable of rotating a suitable shaft including an attachment body containing a longitudinally extending chamber and an elongate shaft rotatably mounted in this body and projecting from a rear end thereof. A cam and cam follower mechanism in the chamber convert rotary motion of the shaft into a reciprocating linear motion. There is a shaft mechanism mounted in the body for sliding reciprocating movement only relative to the body and connected to the cam follower. This shaft mechanism projects from a front end of the body. A brush is attached to a front end of the shaft mechanism and reciprocates with this mechanism in the longitudinal direction thereof. The brush attachment can be mounted on the power tool so the attachment body remains stationary relative to the tool when the shaft is rotating.

19 Claims, 3 Drawing Sheets

POWERBRUSH ATTACHMENT

BACKGROUND OF THE INVENTION

This invention relates to brush attachments for power tools including an attachment designed to convert rotary motion provided by a power tool to reciprocating motion.

Various brush designs intended for cleaning purposes are known and have been used for a considerable length of time. These include brushes intended for use on various power tools. For example, it is known to use large rotating brushes on floor polishing equipment. Often the bristles on these brushes are soft and flexible so as not to damage the surface which is being cleaned and to provide a shiny finish to the surface. Rotating brushes are also known for use in cleaning attachments such as those typically used in conjunction with vacuum cleaners. These brushes are used to pick up dirt and lint from the surface being cleaned, which is often a carpet or rug.

Very stiff wire brushes are also known for use in certain cleaning and abrading operations. For example, wire brushes are known for removing rust from metal surfaces or for removing old paint. Generally speaking, wire brushes of this type are only used where the strong, metal bristles will not damage the surface that is being cleaned.

The use of machines for sandblasting is also well known for cleaning certain surfaces such as brick and stone work as well as metal surfaces. Generally speaking, these machines are intended for large cleaning jobs as they tend to be relatively expensive and generally require the use of a large air compressor. Standard sandblasting techniques can create considerable dust and other debris and therefore such cleaning methods are normally used outside in an environment where the dust and debris can be tolerated. However, sandblasting does have the advantage of providing a relatively quick method for cleaning surfaces that are very difficult to clean by other methods, such as by brushing and washing.

Early U.S. Pat. No. 1,007,888 dated Nov. 7, 1911 and issued to P. W. Parker describes a special brush device designed for use in association with a vacuum cleaner. The brush is rotated by its own electric motor mounted in a specially shaped housing. On an extension of this housing is mounted an elongate sleeve having a cam mounted at one end. This cam co-acts with a further cam which extends around a shaft that is connected to the shaft coming from the motor. A coiled spring is connected to the latter cam. At the forward end of the first mentioned shaft is an annular brush which can be made with stiff wire or fiber. This brush is mounted in the intake end of the vacuum tube. The device can be arranged to impart both a reciprocatory and a rotary movement to the brush by means of engagement between the cams. This known device is said to be suitable for cleaning stone, cement and similar surfaces where a slight abrasive action is desired. A difficulty with this known device is that it is only designed for use in conjunction with a special vacuum cleaner attachment.

A more recent patent illustrating a mechanism for reciprocating a cleaning brush is U.S. Pat. No. 2,671,914 issued Mar. 16, 1954 to R. V. Rucker. This specification teaches a mechanism for converting rotary motion to a reciprocal lateral motion. It requires the use of a dedicated electric motor mounted in a hollow housing that is connected to a handle. The motor turns a bevelled pinion gear which rotates a drive gear having a gear segment affixed thereto. This gear segment engages a rectangular rack causing it first to reciprocate in one direction when its upper teeth are engaged and reciprocate in the opposite direction when its lower teeth are engaged. This reciprocating rack has a brush affixed thereto. Means are also provided for pumping liquid from a reservoir to the brush.

An object of the present invention is to provide an easy to use brush attachment useful for cleaning, particularly the cleaning of surfaces where a sandblasting technique would normally be called for. Another object of the present invention is to provide a brush attachment that can readily be mounted on existing, widely used power tools, such as a power drill, thus reducing the cost of the device substantially. The attachment is able to selectively either rotate the brush about an axis parallel to the bristles or reciprocate the brush in the longitudinal direction of the bristles.

It is a further object of the invention to provide a unique brush construction that is particularly suited for cleaning in a manner that might be considered similar to sandblasting. This unique brush attachment employs tough, flexible bristles which are capable of restoring themselves substantially to their original shape after repeated bending. The bristles of the brush can vary in length from long, centrally located bristles, to shorter bristles located at two opposite sides of the brush.

In the preferred embodiment of the brush, there is a brush body which is generally rectangular with a central longitudinal axis and the long bristles extend along this longitudinal axis. In one preferred embodiment of the brush, the bristles are made of a stiff, wavy polypropylene or nylon material.

SUMMARY OF THE INVENTION

According to one aspect of the invention, a brush attachment for a power tool capable of providing rapid reciprocating motion in a desired direction comprises a brush body having a front surface and tough, flexible bristles having their inner ends firmly mounted in this brush body so as to cover an area on the front surface this area having a centerpoint. The bristles are capable of restoring themselves substantially to their original shape after repeated bending. The bristles taper in length from long, centrally located bristles to shorter bristles located at opposite extremities of the brush located on opposite sides of the centerpoint. The taper is substantially even from the centerpoint of the area to the opposite extremities. There are also means for connecting the brush body to a power tool.

According to another aspect of the invention, a brush attachment for a power tool capable of rotating a suitable shaft includes an attachment body containing a longitudinally extending chamber and an elongate shaft rotatably mounted in this body and projecting from a rear end thereof. There is a mechanism in the chamber for converting the rotary motion of the shaft into a reciprocating linear motion in the direction of the elongate shaft. In addition, a shaft mechanism is mounted in the body for sliding reciprocating movement only relative to the body and is connected to the converting mechanism. This shaft mechanism projects from a front end of the body. A spring is mounted at one end of the attachment body and engages a shaft mechanism. The spring is adapted to drive the shaft mechanism rapidly in a forwards direction as part of the reciprocating linear motion. A brush is attached to a front end of the shaft mechanism and is adapted for reciprocating motion with the shaft mechanism in the longitudinal direction thereof. There are also means for detachably mounting the brush attachment on the power tool so that the attachment body remains stationary relative to the power tool when the shaft is rotating.

According to a further aspect of the invention, a power tool for cleaning or abrading a surface or structure includes a power tool mechanism having a motor and means for controlling the operation of this motor and an elongate rotatable shaft mounted in this mechanism and operatively connected to the motor for rotation. There are also means for converting the rotary motion of the shaft into a reciprocating motion and a shaft mechanism capable of reciprocating movement relative to the power tool mechanism and connected to the converting means. There are means for slidably mounting the shaft mechanism s that the shaft mechanism reciprocates only relative to the mounting means. A brush is attached to the front end of the shaft mechanism and is adapted for reciprocating motion with the shaft mechanism in the longitudinal direction thereof. The brush has bristles that cover an area of the brush, this area having a centerpoint, and vary in length from long, centrally located bristles to shorter bristles located at opposite extremities of the brush located on opposite sides of the centerpoint.

In one particular preferred embodiment, there are additional means provided for reciprocating the brush with a lighter, shorter stroke, rather than the full, normal reciprocating motion.

Further features and advantages will become apparent from the following detailed description taken in conjunction with the accompanying drawings.

DETAILED DESCRIPTION OF THE PREFERRED EMBODIMENT

Figure 1:
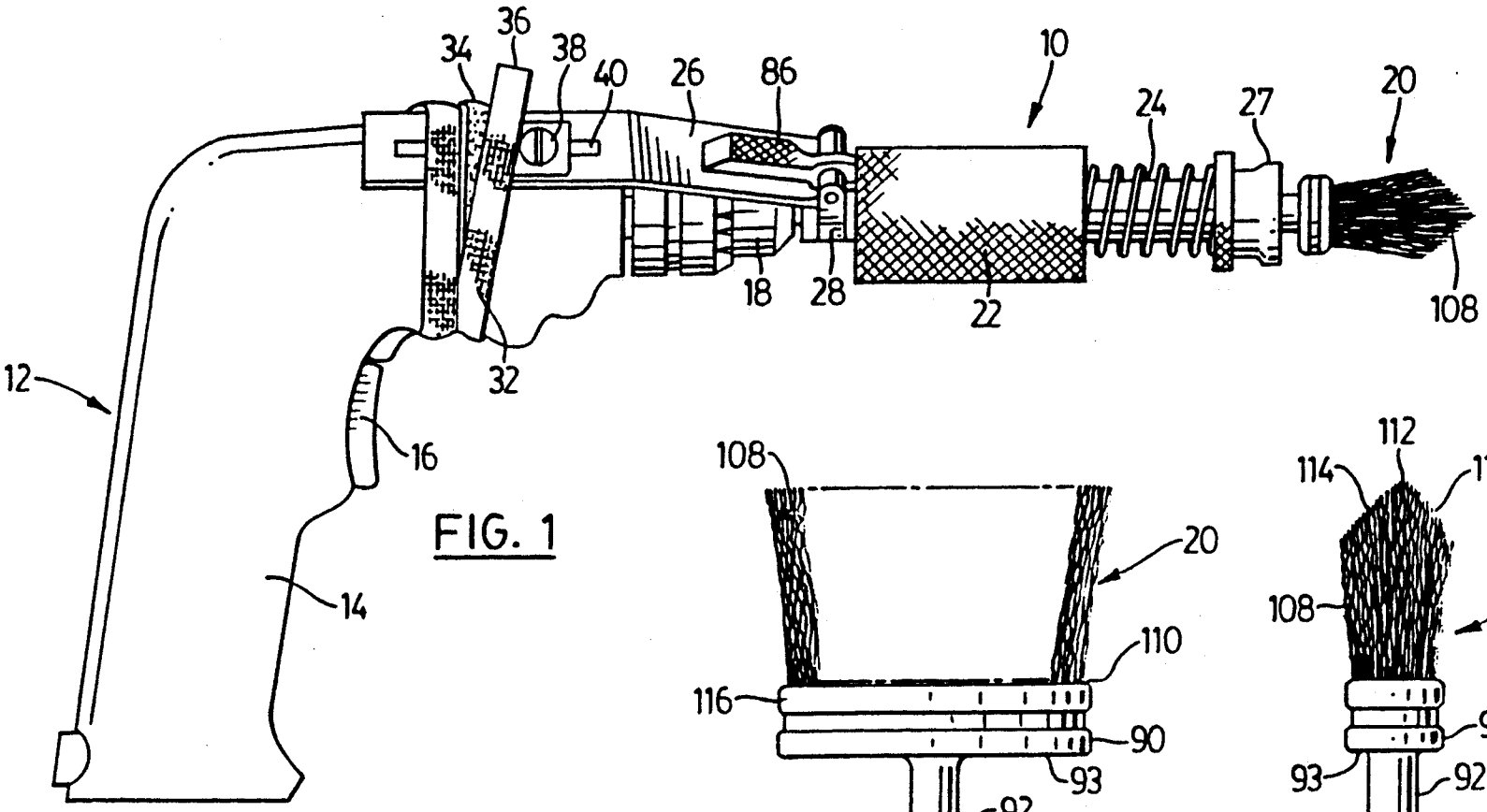
FIG. 1 is a side view of a power tool with a brush attachment constructed in accordance with the invention connected thereto.

FIG. 1 illustrates a preferred form of brush attachment 10 designed and constructed for use with a power tool 12 capable of rotating a suitable shaft. The illustrated power tool is a standard portable electric drill having a handle 14 and an operating trigger or button 16. As is well know, these drills can be provided with an electrical cord for attaching the drill to a power source or they can be provided with a suitable internal battery that provides a source of power for a period of time before it needs to be recharged. The front end of the drill is provided with a standard chuck mechanism 18 which is usually adjustable to fit a number of drill bit sizes and which can be tightened by means of a suitable key (not shown) to secure the drill bit in the drill for rotation.

The major components of the brush attachment 10 of the present invention which are illustrated in FIG. 1 include a brush 20, an attachment body 22, a suitable coil spring 24, and a brush locking hub 27. The mechanism for mounting the brush attachment on the power tool is also shown in FIG. 1. These mounting means can selectively cause the attachment body 22 to either rotate or remain stationary relative to the power tool When the shaft, which is inserted in the chuck mechanism 18, is rotated. The mounting mechanism includes an elongate lever member 26 and a bracket 28 which is rotatably mounted on an elongate shaft 30, which is a shaft whose end 31 is inserted in the chuck mechanism 18. The lever member 26 is pivotally connected to the bracket and is adapted for engagement with the power tool as shown in FIG. 1.

In the illustrated preferred embodiment, the lever member has connected thereto a strap 32 which is preferably elastic. At each end of the strap are Velcro*-type fasteners 34 and 36 which are provided to secure the strap tightly around the power tool in the manner illustrated in FIG. 1. It will be appreciated that because the strap is elastic and because of the use of the Velcro-type fasteners, the brush attachment of the invention can be secured to a variety of power drills of different makes. Furthermore, the lever member can be provided With an adjustable pin 38 that is slidable in a slot 40. The projecting end of this pin is inserted in any suitable hole, slot or opening formed in the side of the power drill in order to provide a positive, mechanical engagement that prevents the lever member from being rotated about the side of the drill.

Turning now to the construction of the attachment body 22, this body is preferably cylindrical and made of a suitable metal such as steel. It can have a knurled outer surface to permit it to be gripped easily. Extending most of the length of the body is a longitudinally extending, cylindrical chamber 42. Closing the rear end of this chamber is a cylindrical cup member 44, which fits into the recessed end of the body 22. This member is secured in place by screw 45 shown in FIG. 5. An integral, cylindrical extension 46 projects from the front end of the body and has a central passageway 48 formed therein. A spring seat 50 is formed where this extension 46 meets the wider main portion of the body 22. The rear end of the aforementioned spring 24 engages the main body 22 at this point.

Extending into the attachment body 22 is the aforementioned shaft 30 which has a reduced front end portion at 52. A collar thrust washer 54 is mounted in the cup member 44 and the shaft 30 is rotatably mounted in the washer 54. On the inside of the chamber 42 and next to the washer 54 is a spring thrust washer 56 against which rests the rear end of a coil spring 58, the purpose of which is described hereinafter. Mounted for rotation with the shaft 30 is a spiral cam member 60. The spring 58 engages a small shoulder formed on the shaft 30, thereby biasing the shaft and the spiral cam member towards the position shown in FIG. 2.

Figure 2:
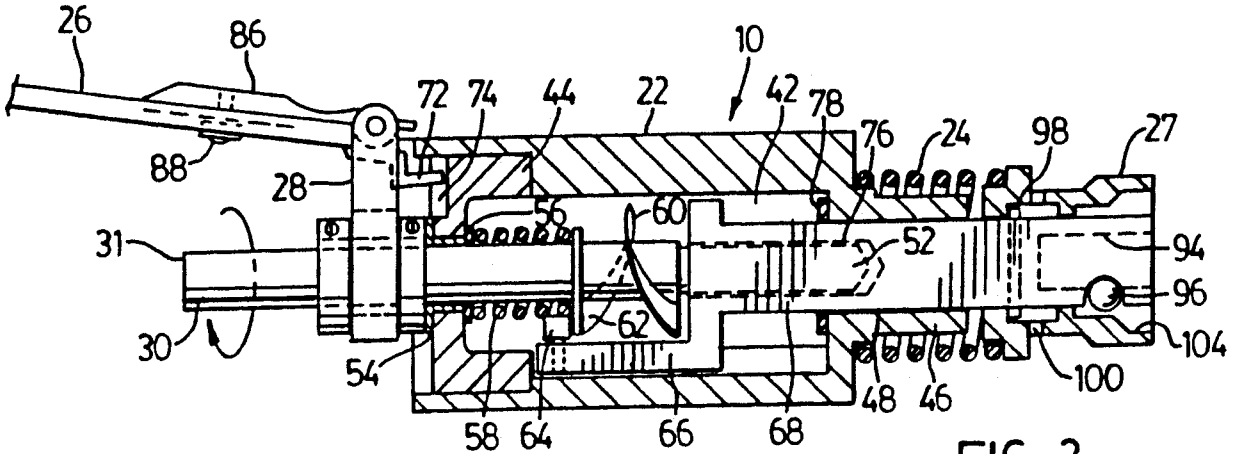
FIG. 2 is an axial cross-section of the brush attachment showing the cam mechanism for converting rotary motion to reciprocal motion but not showing the brush itself.
Figure 3:
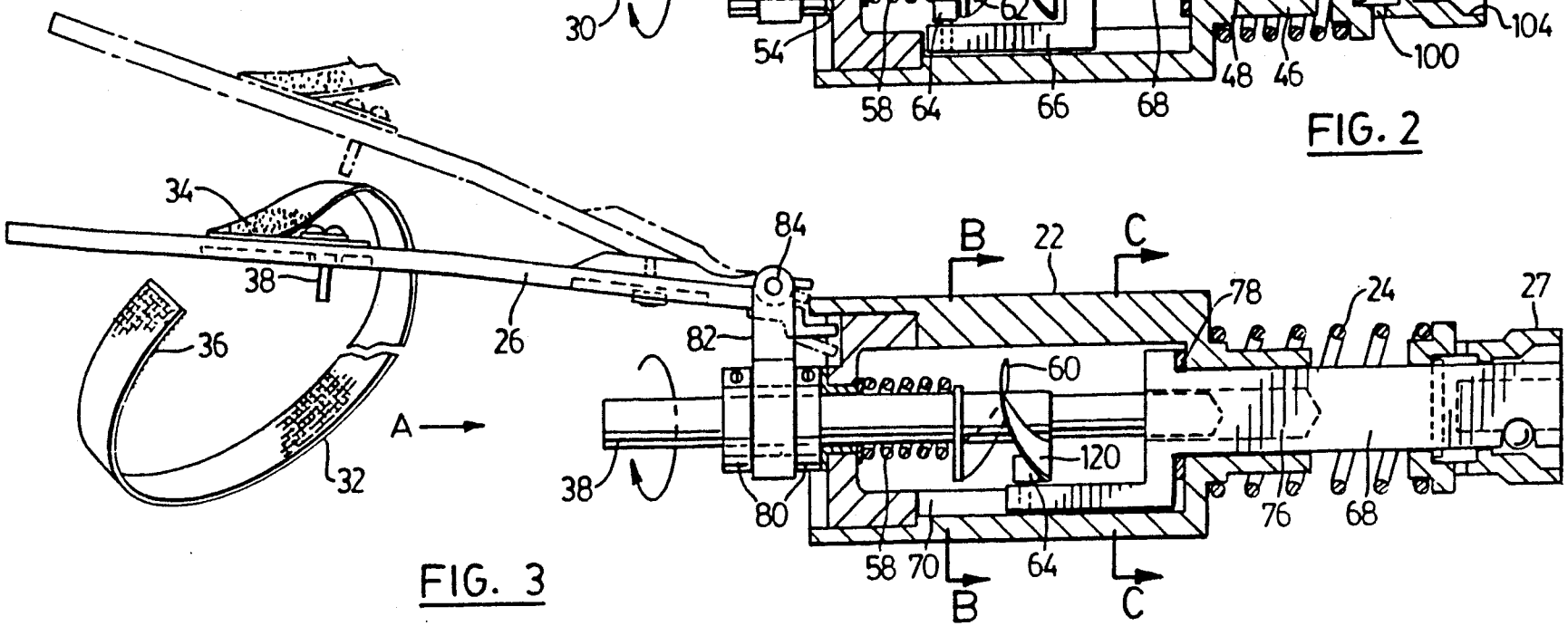
FIG. 3 is an axial cross-section similar to FIG. 2 but showing the shaft mechanism to which the brush is attached fully extended along with the surrounding coil spring.
Figure 4:
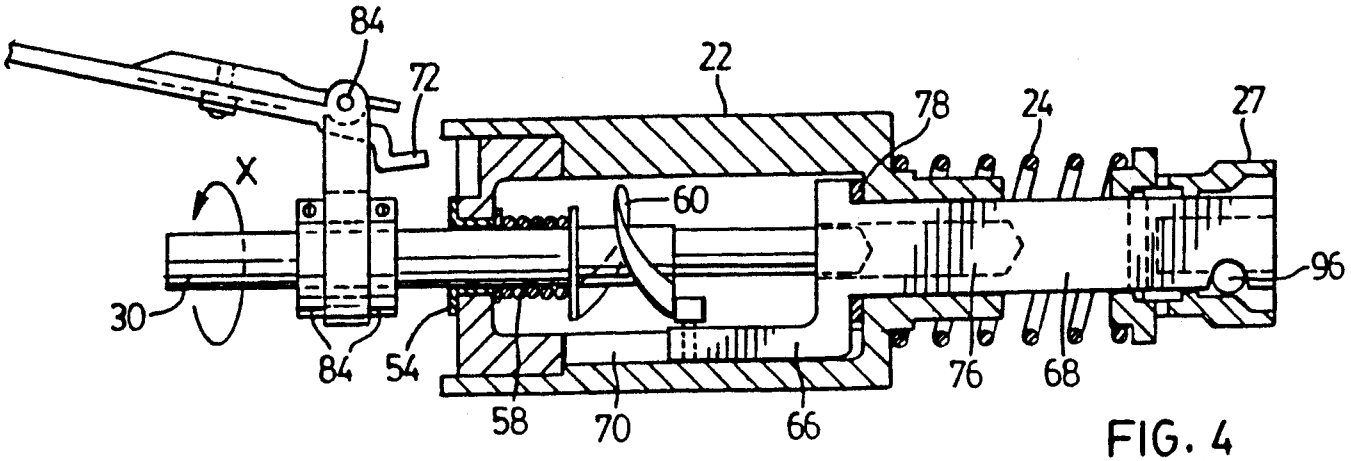
FIG. 4 is an axial cross-section of the brush attachment of FIGS. 2 and 3 showing the inner action between the spiral cam and the cam follower when the direction of rotation of the input shaft is reversed.
Figure 7:
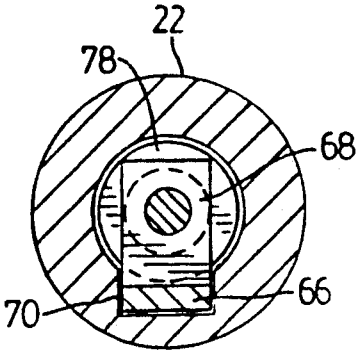
FIG. 7 is a transverse cross-section of the brush attachment taken along the line C—C of FIG. 3.
Figure 6:
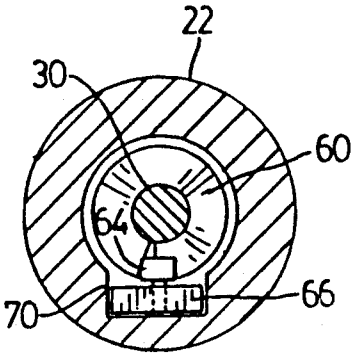
FIG. 6 is a transverse cross-section of the brush attachment taken along the line B—B of FIG. 3.

The brush attachment 10 is provided with means in the chamber 42 for converting the rotary motion of the shaft 30 into a reciprocating motion and, in particular, a reciprocating linear motion. The converting means includes the aforementioned cam member 60 and a cam follower 64, preferably in the form of a roller. This cam follower is mounted in a yoke portion 66 which is part of a shaft mechanism 68. The yoke portion 66 is located in the chamber 42 and slidable in a groove 70 formed in a wall of this chamber. The engagement between this yoke portion 66 and the groove 70 prevents rotation of the shaft mechanism relative to the body 22. As shown in FIG. 2 to 4, the shaft mechanism 68 extends through the passageway 48 and projects forwardly out of the body 22. The locking hub 27 is attached to the front end of this shaft mechanism.

The preferred brush attachment 10 includes a manually operated engaging member for selectively causing the converting means, i.e. the cam 60 and the cam follower 64, to either operate or not operate upon rotation of the shaft 30. It will be understood that if the converting means is not operating, the brush of the attachment is simply rotated, Which motion may be desired for some cleaning operations. The preferred illustrated engaging member is a dog 72 pivotally and slidably mounted on the bracket 28. A suitable recess 74 is formed in the rear end of the attachment body 22 and, in particular, in the cup member 44 as shown in FIG. 2. The dog 72 can be pushed into the recess 74 which prevents the body 22 from rotating with the shaft 30. This in turn prevents the shaft mechanism 68 from rotating which causes the cam follower 64 to move along the spiral cam member 60 until it reaches the top or rear end of the spiral cam member as shown in FIG. 2. This action causes the coil spring 24 to be compressed so that when the cam follower 64 is suddenly released at the end of the spiral path, the shaft mechanism 68 is driven forwardly quickly and with considerable force by the spring 24.

The extended position of the shaft mechanism 68 is illustrated in FIG. 3 where the spring 24 is fully extended and the cam follower 64 is at its forward most position about to engage again the spiral cam member 60. It is important to note that in this forwardmost position the front end of the shaft 30 is still seated firmly in pilot hole 76 formed in the shaft mechanism. Thus, the shaft 30 is properly supported at all times and there is not undue wear and tear on the thrust Washer 54. Another preferred feature is the provision of a rubber washer 78 at the forward end of the chamber 42. This washer helps to cushion the shock of the shaft mechanism 68 striking the forward end of the chamber and helps to reduce the noise of operation.

Figure 5:
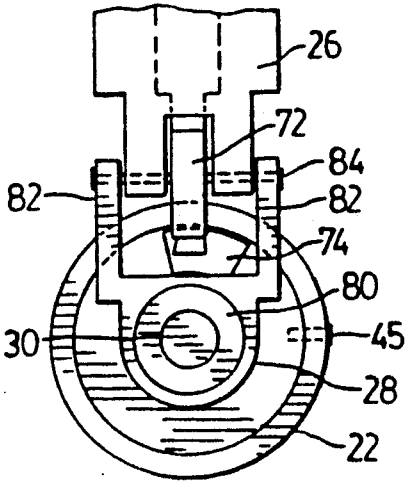
FIG. 5 is an inner end view of the brush attachment of FIG. 3 taken in the direction of the arrow A.

The construction of the bracket 28, the lever member 26 and the dog will now be further described with reference to FIG. 5. Two locking collars 80 are clamped on the shaft 30 on opposite sides of the bracket 28 so as to prevent axial movement of the bracket. The bracket 28 forms two parallel support arms 82 which are connected together by means of a pivot pin 84. As shown in FIGS. 4 and 5, the lever member 26 is pivotally mounted on the pivot pin 84 and the dog 72 is slidably mounted thereon. The dog 72 can be operated by pushing on a rearwardly extending portion 86 which is held in the position shown in FIG. 2 by means of a screw 88. A rubber washer clamped by the head of the screw 88 helps to hold the dog 72 in the desired position.

The brush 20 includes means for connecting the body 90 of the brush to the power tool and, in particular, to the remainder of the brush attachment 10. The preferred illustrated connecting means comprises a metal shaft 92 which extends perpendicularly from a rear surface 93 of the brush body. The shaft 92 is connected to the brush attachment by insertion into a central passageway 94 located in the front end of the shaft mechanism 68. There are means for securing the shaft 92 in the passageway 94. In particular, near the front end of the shaft mechanism 68 there is an opening for receiving and accommodating a locking ball 96. This ball is held in place by the aforementioned locking hub 27 which itself is secured to the forward end portion of the shaft mechanism 68 by transversely extending pin 98. The pin 98 can be inserted through holes 100 formed in opposite sides of the hub 27. The locking ball 96 fits into a recess 102 formed near the end of shaft 92. It will be appreciated that the shaft 92 can be removed from passageway 94 by pushing the hub 27 against the action of the coil spring towards the body 22. This inward motion of the hub permits the ball 96 to move radially outwardly into the wider end region 104 of the central passageway that extends through the hub 27.

Turning now to the construction of the brush itself, the brush 20 comprises a large number of tough, flexible bristles 108 which have their inner ends firmly mounted in the brush body 90 by any suitable, known means. The bristles cover at least a substantial portion of the front surface 110 of the brush body. Because the bristles are intended to strike hard against a surface to be cleaned by means of a linear movement perpendicular to the surface to be cleaned, the bristles should be capable of restoring themselves substantially to their original shape after repeated bending and flexing. The bristles should also be arranged in the manner shown in FIG. 9, that is, they should vary in length from long centrally located bristles 112 to shorter bristles 114 located at two opposite sides of the brush. The reason for having bristles that vary in length in this manner is to prevent the brush in use from simply bouncing in an ineffective manner off the surface being clean or abraded. With the described arrangement, the bristles will not all strike the surface at the same time but will in fact strike the surface at various times during the course of the outward movement of the brush. This system assists greatly in the operation of the present brush attachment and makes it a very effective cleaning device that operates in a manner that might be considered similar to sandblasting. Thus, the end of each bristle in the brush as it strikes the surface to be cleaned, acts like a small particle of sand thrown against the surface by rapidly moving air.

Figure 9:
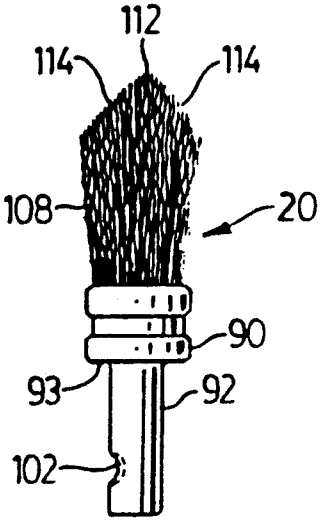
FIG. 9 is an end view of the brush of FIG. 8.
Figure 8:
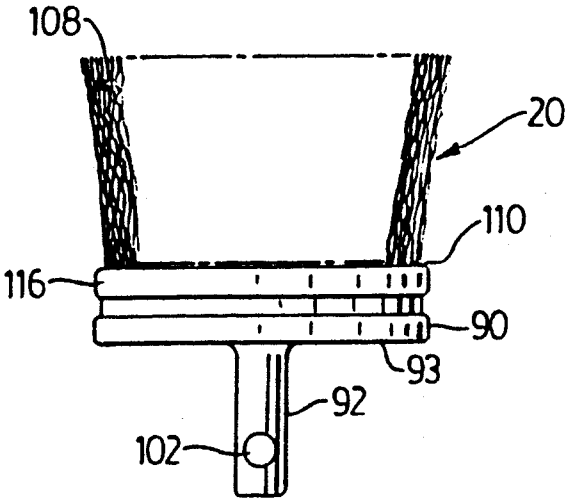
FIG. 8 is a side view of a brush constructed for use with and mounting in the power tool attachment of FIGS. 3 and 4.

As shown in FIG. 8 and 9, the preferred brush body is generally rectangular with a central longitudinal axis extending parallel to each of the long sides 116. The long bristles 112 extend along this longitudinal axis. The preferred material for the bristles is nylon, most preferably nylon 612, but polypropylene is another usable material. Nylon 612 is an excellent material for the bristles as it has the qualities of superior flexibility, excellent abrasiveness, good impact qualities, and resistance to chemicals. It also absorbs very little, if any, water. Polyethylene UHMW is another excellent bristle material in that it does not absorb water and it has superior impact qualities. The preferred form of bristle is a bristle having a short wavy appearance and it is believed that such bristles have a better cleaning ability. In one preferred embodiment of brush constructed in accordance with the invention, the fiber size used was 0.016 inch and the average fiber length for the complete brush was approximately ⅞ths inch. The surface area covered by the bristles was approximately 1 square inch. In determining the preferred fiber size and fiber length for the bristles and the strength of bristles to be used, one must take into consideration the strength of the spring 24. The larger and stronger the spring 24 is, the stronger the bristles should be made so that they can withstand the driving force acting on them.

In one preferred embodiment of the present brush attachment, the coil spring 24 was made of carbon steel and had a wire diameter of 0.092. The outside diameter of the spring was 1.055 inch while the inside diameter was 0.875 inch. This spring had a free length of 1 ⅞th inch and could deflect or contract approximately 50% of its free length. This steel spring was suitable for use with the specific type and size of bristles detailed above.

FIG. 4 of the drawings illustrates what occurs when the shaft 30 is rotated in the reverse direction indicated by the arrow X in the figure. FIG. 3 illustrates the fully extended position of the brush attachment wherein both the spring 24 and the shaft mechanism 68 are fully extended. If the shaft 30 is rotated clockwise, the cam follower 64 will immediately commence to engage the spiral cam 60 causing compression of the spring 24. However, if the shaft 30 is rotated counterclockwise, the cam follower will first become disengaged entirely from the spiral cam 60 and then, upon a complete rotation of the spiral cam, will engage the bottom surface of the spiral cam at 120. If the body 22 is gripped so that it cannot rotate, further counterclockwise rotation of the shaft 30 will cause the cam follower to move the spiral cam rearwardly in the chamber and to compress the small coil spring 58. This also results in the attachment body 22, the shaft mechanism 68 and the brush being moved a short distance forwardly relative to the shaft 30. This continues until the cam follower again disengages from the spiral cam member at the position illustrated in FIG. 4 when the body 22 and the brush are again driven rearwardly under the action of the spring 58. It will thus be appreciated that in the reverse direction and provided that the body 22 is held against rotation, the preferred brush attachment of the invention is able to cause the brush 20 to reciprocate lightly a short distance (relative to the much longer stroke provided by rotating the shaft 30 in the opposite direction). In this way, the preferred brush attachment of the invention is able to provide two different types of reciprocating strokes for cleaning purposes. The stroke that would be chosen depends upon the particular requirements of the cleaning job, i.e. whether a strong cleaning and abrading action is required or only a light cleaning action. If the body 22 is not prevented from rotating, the brush will simply rotate when the shaft 30 is rotated in the reverse direction.

If desired, a rubber sleeve can be placed over the coil spring 24 so that the spring will not be exposed. The provision of such a sleeve will help to prevent fingers or other body parts from being pinched by the spring action.

It will also be understood by those skilled in this art that the brush attachment 10 described and illustrated herein can, if desired, be incorporated as an integral part of a power tool. In other words, a power tool could be constructed in which the input shaft 30 is permanently connected to a drive motor. Furthermore, if a cleaning tool having a brush with no rotary action is desired, the body 22 can simply be an integral extension of the housing in which the drive motor is mounted and arranged. Although such a dedicated power tool might have less versatility, in that it could not be used for other purposes such as normal drilling, such a tool might be less expensive to manufacture than the total cost of a separate power tool such as a power drill and a separate brush attachment constructed as described herein.

It will be apparent to those skilled in this art that various modifications and changes are possible and can be made to the brush, brush attachment and power tool described herein without departing from the spirit and scope of this invention. Accordingly, all such modifications and changes are intended to be par of this invention.

I therefore claim:

1. A brush attachment for a power tool capable of providing rapid reciprocating motion in a desired direction comprising a brush body having a front surface; tough, flexible bristles having their inner ends firmly mounted in said brush body so as to cover an area of said front surface, said area having a centerpoint, said bristles being capable of restoring themselves substantially to their original shape after repeated bending by said tool, said bristles tapering in length from long, centrally located bristles to shorter bristles located at opposite extremities of the brush located on opposite sides of said centerpoint, the taper being substantially even from said centerpoint of said area to said opposite extremities; and means for connecting said brush body to said power tool.

2. A brush according to claim 1 wherein said brush body is generally rectangular with a central longitudinal axis and said long bristles extend along said longitudinal axis.

3. A brush according to claim 2 wherein said bristles comprise wavy polypropylene or nylon bristles.

4. A brush according to claim 1 wherein said bristles comprise wavy polypropylene or nylon bristles.

5. A brush according to claim 1 wherein said connecting means comprises a metal shaft extending perpendicularly from a rear surface of said brush body, whereby said bristles extend in said desired direction when said brush attachment is connected to said power tool.

6. A brush attachment for a power tool capable of rotating a suitable shaft, said attachment comprising:

an attachment body containing a longitudinally extending chamber;

an elongate shaft rotatably mounted in said body and projecting from a rear end thereof;

means in said chamber for converting the rotating motion of said shaft into a reciprocating linear motion in the direction of said elongate shaft;

shaft means mounted in said body for sliding, reciprocating movement only relative to said body and connected to said converting means, said shaft means projecting from a front end of said body;

a spring mounted at one end of said attachment body and engaging said shaft means, said spring being adapted to drive said shaft means rapidly in a forwards direction as part of said reciprocating linear motion;

a brush attached to a front end of said shaft means and adapted for reciprocating motion with said shaft means in the longitudinal direction of said shaft means, and means for detachably mounting said brush attachment on said power tool so that said attachment body remains stationary relative to said power tool when said shaft is rotating.

7. A brush attachment according to claim 6 wherein said brush has tough, flexible bristles which are capable of restoring themselves substantially to their original shape after repeated bending.

8. A brush attachment according to claim 7 wherein said bristles cover a area of the brush, which are has a centerpoint, and vary in length from long, centrally located bristles to shorter bristles located at opposite extremities of the brush located on opposite sides of said centerpoint.

9. A brush attachment according to claim 7 wherein said mounting means comprises an elongate lever member and a bracket rotatably mounted on said elongate shaft, said lever member being pivotally connected to said bracket and adapted for engagement with said power tool, said lever member having means for engaging said attachment body so as to prevent rotation thereof when said elongate shaft is rotating.

10. A brush attachment according to claim 7 wherein said mounting means comprises an elongate lever member rotatably mounted on said elongate shaft and having a manually operated engaging member for selectively causing said converting means to either operate or not operate upon rotation of said elongate shaft, said engaging member being able to engage said attachment body so as to prevent rotation thereof when said elongate shaft is rotating.

11. A brush attachment according to claim 7 including means for detachably attaching said brush to the front end of said shaft means.

12. A brush attachment according to claim 6 wherein said converting means includes a spiral cam mounted on said elongate shaft and a cam follower connected to said shaft means and adapted to engage said cam, and wherein said spring is a coil spring extending about said shaft means, which has a shoulder adjacent its outer end against which one end of said coil spring rests.

13. A brush attachment according to claim 6 wherein said shaft means includes a yoke portion located in said chamber and slidable in a groove formed in a wall of said chamber, the engagement between said yoke portion and said groove preventing rotation of said shaft means relative to said body.

14. A brush attachment according to claim 6 including a bracket rotatably mounted on said elongate shaft, a dog mounted on said bracket, and a recess formed on said rear end of said attachment body, and wherein said dog can be pushed into said recess for selectively causing said converting means to operate upon rotation of said elongate shaft.

15. A brush attachment according to claim 6 wherein said converting means includes a spiral cam mounted on said elongate shaft and a cam follower connected to said shaft means and adapted to engage said cam, and wherein said spring is a coil spring extending about said shaft means, which has a shoulder adjacent its outer end against which one end of said coil spring rests; and wherein a second coil spring extends about said elongate shaft adjacent to and rearwardly of said spiral cam, said second coil spring being compressed intermittently by said cam when said elongate shaft is rotated in a reverse direction and causing said brush to be reciprocated lightly a short distance.

16. A power tool for cleaning or abrading a surface or structure comprising:

a power tool mechanism including a motor and means for controlling the operation of said motor;

an elongate rotatable shaft mounted in said mechanism and operatively connected to said motor for rotation;

means for converting the rotary motion of said shaft into a reciprocating motion;

shaft means capable of reciprocating movement relative to said power tool mechanism and connected to said converting means;

means for slidably mounting said shaft means, said shaft means being mounted for reciprocating movement only relative to said mounting means; and a brush attached to a front end of said shaft means and adapted for reciprocating motion with said shaft means in the longitudinal direction of said shaft means, said brush having bristles that cover an area of the brush, said area having a centerpoint, and vary in length from long, centrally located bristles to shorter bristles located at opposite extremities of the brush located on opposite sides of the centerpoint.

17. A power tool according to claim 16 wherein said brush has tough, flexible bristles which are capable of restoring themselves substantially to their original shape after repeated bending.

18. A power tool according to claim 16 including a manually operated engaging member for selectively causing said converging means to either operate or not operate upon rotation of said elongate shaft.

19. A power tool according to claim 16 wherein said converting means includes a spiral cam mounting on said elongate shaft, a cam follower connected to said shaft means and adapted to engage said cam, and a coil spring extending around said shaft means and acting to drive shaft shaft means forwardly during its reciprocal movement, one end of said coil spring resting against said mounting means and another end of said coil spring resting against a shoulder formed on said shaft means adjacent an outer end thereof.

* * * * *